United States Patent [19]

Brennan

[11] 4,133,086

[45] Jan. 9, 1979

[54] PNEUMATIC SPRINGING SHOE

[76] Inventor: John L. Brennan, 11000 Westwood Lake Dr., Miami, Fla. 33165

[21] Appl. No.: 780,528

[22] Filed: Mar. 23, 1977

[51] Int. Cl.[2] ..... A43B 3/10
[52] U.S. Cl. ..... 36/7.8
[58] Field of Search ..... 36/7.5, 7.6, 7.8, 102, 36/29

[56] References Cited

U.S. PATENT DOCUMENTS

| | | | |
|---|---|---|---|
| 1,679,046 | 7/1928 | Menefee | 36/7.8 |
| 1,843,493 | 2/1932 | Pfeifenbring | 36/7.8 |
| 3,251,145 | 5/1966 | Mack | 36/7.8 |

*Primary Examiner*—Patrick D. Lawson

[57] ABSTRACT

A springing-shoe having a foot supporting plate and a ground engaging plate is provided with pneumatic springing means secured between the plates for imparting vertical springing motion but no side sway or twisting motion when the shoe is being used for walking, running or jumping.

7 Claims, 3 Drawing Figures

PNEUMATIC SPRINGING SHOE

BACKGROUND OF INVENTION

Jumping or springing shoes of one form or another have been known for many years, one of the earliest disclosures being that of U.S. Pat. No. 337,146 (1886) which describes a spring shoe utilizing leaf or coil springs. From this time on various modifications of the spring shoe were made as illustrated by U.S. Pat. No. 822,448 (1906), the two patents of Thackery U.S. Pat. Nos. 1566513 and 1672506 and the jumping shoe of Pierce U.S. Pat. No. 3388485 (1968). However, all of these earlier jumping shoes utilized leaf or coil springs and hence each shoe was limited in its usefulness by the inherent elastic or resilient properties of its springs.

SUMMARY OF INVENTION

The instant invention is an improved form of springing-shoe wherein the elasticity or resilience of its spring may be varied so as to insure optimum springing affect for each individual user irrespective of weight, the improved springing-shoe of this invention being characterized by pneumatic springing means in the form of two compressed air type shock absorber cylinders mounted between the foot supporting plate and the ground engaging plate of the shoe each compressed air cylinder having an air valve whereby the air pressure in the cylinders may be varied at will thereby varying the effective resiliency of the spring.

PREFERRED EMBODIMENT OF INVENTION

Figure 1:
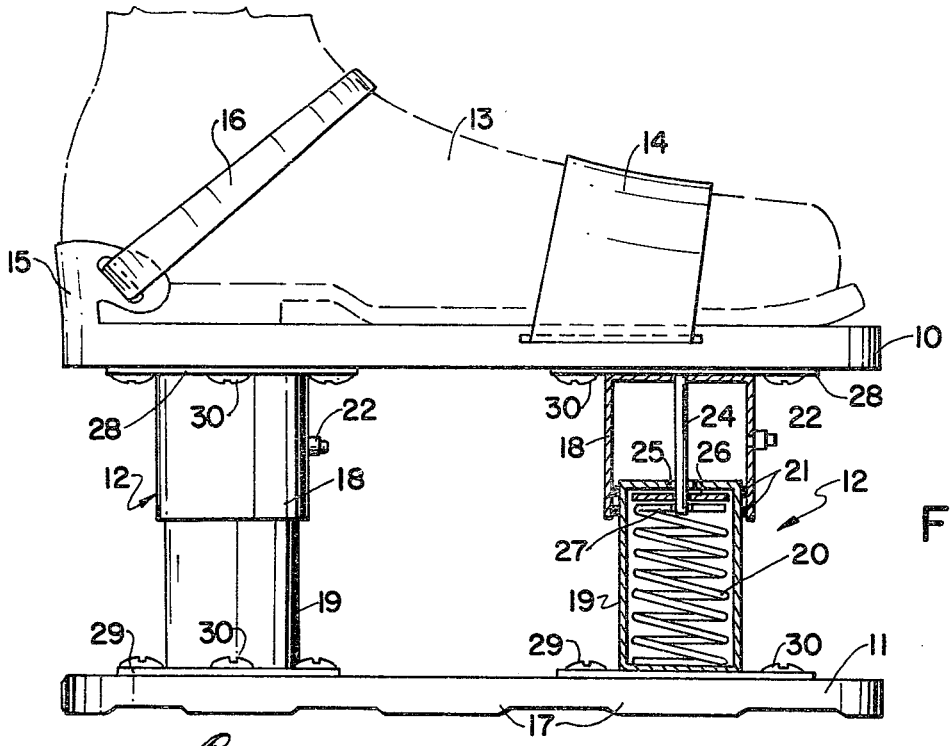
FIG. 1 is a schematic vertical side view, partially in section, of the pneumatic springing-shoe of this invention.

Referring to the drawings, the pneumatic spring-shoe comprises a foot supporting plate 10, a ground engaging plate 11 and pneumatic springing means comprising a pair of compressed air type shock absorber cylinders indicated generally at 12—12.

Figure 2:
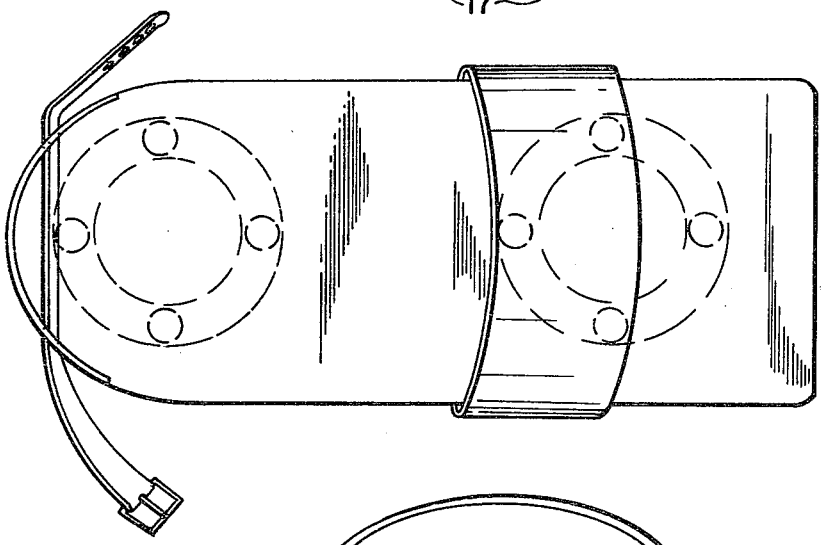
FIG. 2 is a plan view of the pneumatic jumping shoe of FIG. 1.
Figure 3:
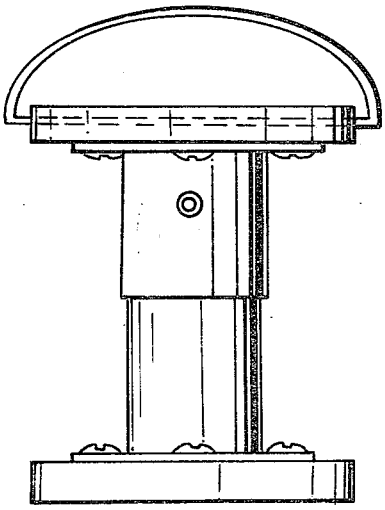
FIG. 3 is a front end view.

Both the foot supporting plate 10 and the ground supporting plate 11 are substantially rectangular except that the rear end of each is rounded off as shown especially well in FIG. 2. The plates may be made of any suitable material such as wood or light weight metal. Preferably, however, each plate is formed of poly vinyl chleride plastic or similar hard but resilient material. The plate 10 is adapted to support the wearer's foot or shoe 13, as the case may be, and to this end the latter is releasably held thereon by means of a toe strap 14 and heel rest 15 provided with an ankle strap 16, both the toe strap 14 and heel rest 15 being fixedly secured in any suitable manner to the plate 10.

The underside of the ground engaging plate 11 is adapted to have a non-skid surface which, as indicated at 17, may comprise alternate transverse grooves and ridges.

The foot supporting plate 10 and the ground engaging plate 11 are supported in vertically spaced substantially parallel relationship by the pair of pneumatic springing means indicated generally at 12—12.

Each pneumatic springing means is a compressed air type shock absorber comprising a cylinder in the form of cylindrical sleeve 18, and a hollow cylindrical piston 19 having both a head and a base and adapted to house a coil compression spring 20. Referring to the drawings the upper end of the piston 19 is dimensioned to slidingly engage in the lower open end of cylinder 18 and is provided with one or more piston rings 21 adapted to make a sliding airtight seal therewith. An air valve 22 is provided in the wall of the cylinder 18 whereby compressed air may be fed into or released from the cylinder 18. Extending downwardly from the underside of the air cylinder 18 is a central rod 24 the lower end of which extends through central aperture in the head of the piston 19. An O-ring 25 forms an airtight seal between the rod 24 and the aperture in the head of the piston; and a disc 26 is secured on the lower extremity of the rod 25 adjacent the underside of the piston head by nut 27. The rod-supported disc 26 thus serves to prevent the piston 19 from sliding out the open end of the cylinder 18; and also provides a seat for the upper end of the coil compression spring 20 the opposite end of which rests on the base of the piston 19.

The addition of compressed air to the cylinder thus has a cushioning effect on the resiliency of the coil compression spring 20 such that by adding compressed air to or releasing compressed air from the cylinder 18 the effective resiliency of the spring 20 may be varied to compensate for users of different weight.

Each pneumatic springing means is adapted to be secured between the foot supporting plate 10 and the ground plate 11 and to this end the upper end of the cylinder 18 and the lower end of the piston 19 are provided with integral annular flanges 28 and 29, respectively, having a plurality of circumferentially spaced apertures for accomodating screws 30 or similar fastening means by which the flange 28 of the cylinder 18 and the flange 29 of the piston 19 are fixedly secured to the respective plates 10 and 11.

In the interest of stability and freedom from side sway, twisting or the like the mean diameter of each pneumatic springing means is preferably about half the width of its respective plate 10 and 11; and the ratio of its mean diameter to its overall height substantially 1:2. Moreover the diameter of each flange 28 and 29, respectively, is indicated as being substantially two thirds the width of the respective plates 10 and 11. It will be understood, however, that the above indicated dimensions are not critical and that variations thereof are contemplated persuant to the objects of the invention.

The manner of operation of the pneumatic springing-shoe of this invention will be clear from the foregoing description taken with the drawings but suffice it to say that the springiness of the shoe will depend upon the effective resiliency of its coil springs 21 in accordance with the air pressure within its shock absorber cylinders; and that this may be varied at will by adding compressed air to or bleeding compressed air from the cylinder 18 via of the air valve 22. Thus each pneumatic springing means provides not only the resiliency required for effecting a springing or bouncing movement but the degree of resiliency may be readily varied to suit the whim of the user and/or to compensate for his or her weight as the case may be.

The invention may be carried out in other specific ways than those herein set forth without departing from the spirit and essential characteristics of the invention and the present embodiment is therefore to be considered in all respects as illustrative and not restrictive, and all changes coming within the meaning and equivalency range of the appended claims are intended to be embraced therein.

I claim

1. A pneumatic springing-shoe comprising a foot supporting plate, a ground engaging plate, a pair of pneumatic springing means, fastening means constructed and arranged to fixedly secure said pneumatic springing means substantially vertically between said foot supporting plate and said ground engaging plate adjacent the forward and rear ends thereof respectively, and a valve associated with each of said pneumatic springing means for varying the resiliency thereof.

2. A pneumatic springing-shoe according to claim 1 wherein said pneumatic springing means comprises a compressed air type shock absorber embodying a coil compression spring.

3. A pneumatic springing shoe according to claim 2 wherein the compressed air type shock absorber comprises an air cylinder in combination with said coil compression spring, and valve means in said air cylinder for varying the air pressure in said air cylinder thereby to vary the effective resiliency of said coil spring.

4. A pneumatic springing-shoe according to claim 3 wherein said fastening means comprises an annular flange at the upper and lower ends, respectively, of said compressed air type shock absorbers, and screws arranged to fixedly secure said flanges to adjacent surfaces of said foot supporting plate and said ground engaging plate, respectively.

5. A pneumatic springing-shoe according to claim 4 wherein said ground engaging plate has an anti-skid surface on the underside thereof.

6. A pneumatic springing-shoe according to claim 4 wherein each plate is substantially rectangular and the diameter of each of the said annular flanges of said compressed air type shock absorbers is substantially two-thirds the width of its respective plate.

7. A pneumatic springing-shoe according to claim 6 wherein each of said plates comprises a substantially rigid plastic material.

* * * * *